United States Patent [19]

Kohlgrüber

[11] 4,003,763

[45] Jan. 18, 1977

[54] METHOD OF AND PLANT FOR PATENTING STEEL WIRE BUNDLES

[75] Inventor: Rolf Kohlgrüber, Cologne, Germany

[73] Assignee: Ofenbaugesellschaft Berg u. Co. m.b.H., Cologne, Germany

[22] Filed: Apr. 7, 1975

[21] Appl. No.: 565,444

[30] Foreign Application Priority Data

Oct. 26, 1974 Germany ..... 2450955

[52] U.S. Cl. ..... 148/15; 266/107; 266/120

[51] Int. Cl.[2] ..... C21D 1/46

[58] Field of Search ..... 134/64 R, 84, 85, 90, 134/105, 122 R; 148/155, 15; 266/6 R, 4 R, 4 A, 4 B, 107, 120, 131

[56] References Cited

UNITED STATES PATENTS

| | | | |
|---|---|---|---|
| 192,239 | 6/1877 | Dion | 266/3 R |
| 931,332 | 8/1909 | Nickerson | 266/4 R X |
| 1,786,508 | 12/1930 | Rosenberg | 266/4 A |
| 1,904,838 | 4/1933 | Rosenberg | 266/4 A |
| 1,913,090 | 6/1933 | Rosenberg | 266/4 A |
| 1,917,547 | 7/1933 | Rosenberg | 266/4 A |
| 1,953,647 | 4/1934 | Darrah | 266/4 R X |
| 2,009,481 | 7/1935 | Darrah | 266/4 A |
| 2,708,445 | 5/1955 | Manson et al. | 134/64 R |
| 3,892,391 | 7/1975 | Okuno | 266/5 R |

FOREIGN PATENTS OR APPLICATIONS

| | | | |
|---|---|---|---|
| 1,758,485 | 2/1971 | Germany | 266/6 R |
| 1,112,682 | 8/1961 | Germany | 134/122 R |

*Primary Examiner*—Roy Lake
*Assistant Examiner*—Paul A. Bell
*Attorney, Agent, or Firm*—Walter Becker

[57] ABSTRACT

Method of and plant for patenting steel wire bundles, according to which a cooling vat is heated by a heating fluid to a temperature of e.g. 500° C considered as cooling temperature for patented steel wire bundles. Into this cooling vat is then introduced the steel wire bundle to be patented which in this way is pre-heated. The thus pre-heated steel wire bundle is subsequently introduced into a hot fluid containing heating vat where the wire bundle is heated to a patenting temperature of e.g. 900° C. After the wire bundle has been patented in this heating vat, it is returned to the cooling vat where it is cooled to the cooling temperature prevailing therein while the cooling vat due to the absorption of heat from the wire bundle being cooled substantially maintains its cooling temperature from one cooling step to the next cooling step.

2 Claims, 5 Drawing Figures

METHOD OF AND PLANT FOR PATENTING STEEL WIRE BUNDLES

With "patenting" is designated in the steel wire industry a method of heat treating steel wire. This method consists in that the wire is first heated to a temperature of from 850 to 1100° C and subsequently is quickly cooled in a lead or salt bath of from 400° to 500° C. By this method it is intended to give the wire a texture which is particularly favorable for subsequent drawing to impart upon the wire a high strength.

The method according to the present invention is intended to recover the heat excess which the lead or salt bath receives due to the fact that the wire is introduced into the lead or salt bath at a temperature which is considerably higher than that of the lead or salt bath. If the lead or salt bath with a great put-through of bundles of wire becomes too hot due to the heat of such bundles or coils of wire, it was heretofore customary to cool the lead or salt bath by the burners of the vat, and more specifically, by causing the burners to act only as blowers. In this way, however, considerable heat quantities were lost.

It is, therefore, an object of the present invention to overcome the above mentioned drawback.

This object and other objects and advantages of the invention will appear more clearly from the following specification, in connection with the accompanying drawings, in which.

Figure 1:
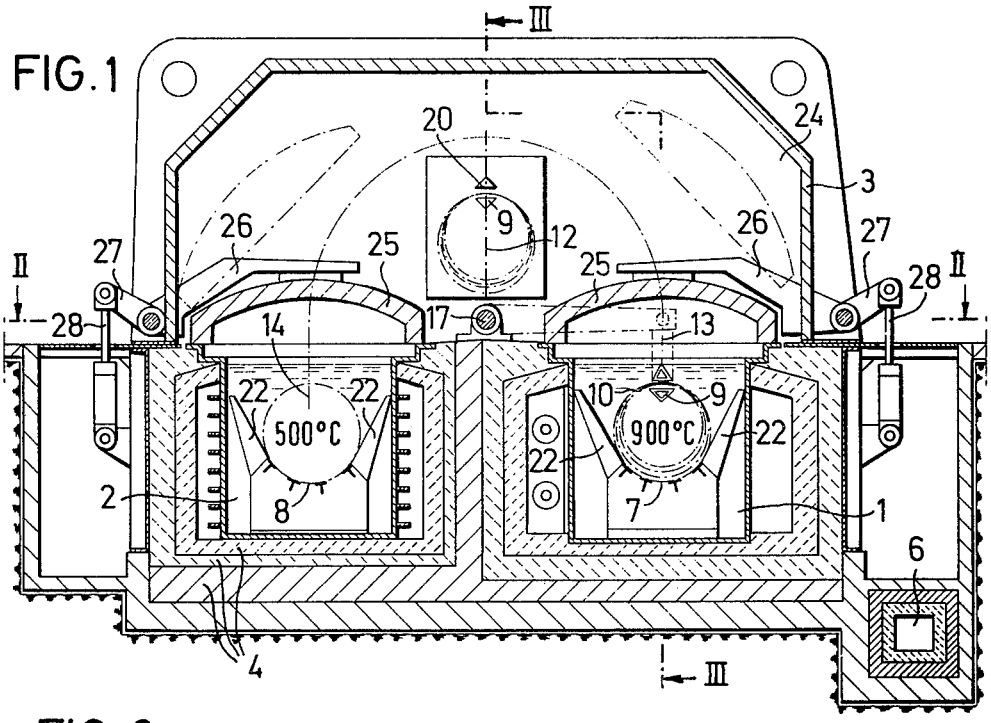
FIG. 1 is a diagrammatic vertical section through a wire patenting plant according to the invention.

The invention consists in method steps which will be enumerated herebelow after the furnace as well as the liquid in the cooling vat have been heated to the required temperature operation. The method steps are as follows:

a. The not-yet patented wire bundles are in cold condition introduced into the cooling vat.
b. The wire bundles are withdrawn from the cooling vat and introduced into the furnace.
c. The wire bundles after having been sufficiently heated in the furnace are introduced into the cooling vat.

Thus, in conformity with the present invention, the wire bundles are preheated prior to the furnace. This means that the heating of the wire bundles to the necessary maximum temperature will take place faster. The lead or salt bath retains in conformity with the method of the invention its normal temperature operation so that less time than heretofore necessary is needed to bring the lead or salt bath to its temperature of operation. In this connection, it may be mentioned that the application of the method according to the invention is not limited to a certain design of the wire patenting plant. Thus, for instance, it is possible within a wire patenting plant to employ a furnace in which the wire bundles are heated by hot gases. Another possibility consists in that the furnace has a vat which contains heated lead into which the wire bundles are immersed and heated in this way.

It is of particular advantage when the method according to the invention is applied to a wire patenting plant which has two vats arranged adjacent to each other, one of which is filled with a liquid for heating and the other one of which is filled with a liquid for cooling. Within the wire patenting plant there is provided a beam which catches from below the wire bundles from the interior of said wire bundles in their vertical longitudinal central plane and over their entire length. The beam forms a part of a pivoting device which can move the beam by a semicircle above the vats/ While the two vats together with the pivoting device are covered by a hood which is closed on all sides in one side wall the hood has an opening which is adapted to be closed and also to be opened for introducing and withdrawing the wire bundles.

The above described wire patenting plant is, according to the invention, preferred to a wire patenting plant which has a gas-heated furnace. The reason for this consists in that with a gas-heated furnace, the method according to the invention can, due to the simplicity of the conveying device be carried out more easily. However, in this connection the following points are also important: When heating by gas, it cannot be avoided that in the gas oxygen residues are still present. This brings about that the wire bundles when being heated may at some areas scale or oxidize. Scale occurring on the wire is the reason for the fact that the wire when viewed over its entire length is not uniformly heated everywhere. In addition thereto, scale is harmful during the cooling-off period because it insulates the wire area-wise whereby a differently strong cooling of the wire over its length is effected. It may also be mentioned that a scaling or oxidation brings about a carburizing of the rim. A scaling or oxidation furthermore represents a loss in material. For the subsequent drawing, therefore, a considerable loss in the pickling acid has to be put up with. When the wire for purposes of heating is immersed into a liquid in which no oxygen is present, a scaling or oxidation will be avoided, as a result of which also the subsequent cooling is effected most efficiently.

According to the invention, the beam is on one side connected to a pivot arm which is likewise arranged in the furnace and which is mounted in a vertical plane located at even distance from both vats between the latter and extending parallel to the vertical longitudinal central planes of the vats. In this connection, it is of particular advantage when the beam is linked to the pivot arm through the intervention of an upwardly directed arm which is rigidly connected to said beam. This will assure that the arm will during the pivoting operation carry out no rolling movement within the wire bundles.

The pivot arm is mounted on a shaft which is driven by a drive motor through a transmission. In conformity with the invention, the transmission is so designed that the pivot arm in its two end positions is pivoted by a small acute angle upwardly and downwardly. As an advantage thereof, the wire bundles are moved in both liquids whereby all windings or turns of the wire bundles are passed around by liquid. This is of great importance for a uniform heating up and cooling down of the wire.

Experience has shown that it is expedient that the heating vat contains liquid lead. The cooling vat expediently contains a salt bath. This salt bath is not under all circumstances necessary. The cooling vat may also contain liquid lead. However, in such an instance, care is to be taken that in view of the low cooling temperature, no lead remains on or will adhere to the wire.

The employment of lead as heating or cooling bath makes it necessary to provide means which will prevent the wire which is specifically lighter than lead from floating upwardly. For this reason, according to the invention there is provided a second beam located above the first mentioned beam in spaced relationship thereto, which space corresponds approximately to the thickness of the wire bundles. This second beam expediently ends at its front end in an upwardly directed bend. This bend facilitates the suspending of the wire bundles on the beam by means of the charging machine for introducing the wire bundles into the furnace.

A further step for preventing a floating movement of the wire in the lead bath consists according to the invention in that the two troughs in the furnace are laterally and at their head ends provided with extensions which extend at an incline in upward direction and in the direction toward the outside.

In order to be able to keep oxygen away from the bath in the furnace, it is suggested in accordance with the present invention within the free space surrounded by a hood and located above the level of the vats to provide movable covers for the two vats. These covers are connected to arms which are arranged above the hood and extend outwardly. The arms form together with each extension outside the hood a two-arm lever having its free end connected to a hydraulically movable connecting rod.

Referring now to the drawings in detail, the steel wire patenting plant according to the invention forms primarily a furnace. This furnace serves for heating and subsequent cooling of wire bundles of rolled wire. The new feature of the furnace according to the present invention over heretofore known furnaces of the type involved and serving the same purpose, consists primarily in that the heating of the wire bundles is effected in a heated liquid lead-filled vat 1. If a salt bath suitable for high temperatures is available, also a salt bath can be employed in the vat 1. A vat 2 for a later cooling of the wire bundle is likewise together with vat 1 arranged in the furnace which is covered by a detachable hood 3. In vat 2 there is provided a lead or salt bath. The vats 1 and 2 are embedded in a refractory and insulating surrounding which also contains the burners for generating the heating gases as well as the drafts for guiding the heating gases about the vats 1 and 2. The heating of the vat 1 is effected by means of the burners 5 always by fresh heating gases. The heating of the vat 2 is effected by a so-called rotation heating according to which the heating gases which have already given off their heat to the vat 2 are returned to the burners of the vat 2 and are intermixed with fresh heating gases from the burners. The burners of the vat 2 are not illustrated because the above mentioned heating types of vats are known per se. The heating gases to be withdrawn leave the furnace through the flue 6. The heating of the two vats 1 and 2 is so controlled that the lead bath in vat 1 has a temperature of approximately 900° C, whereas the salt bath in the cooling vat 2 has a temperature of approximately 500° C.

In the vats 1 and 2 there are provided longitudinally extending troughs 7 and 8 for receiving the wire bundles in loosened condition with their turns occupying a vertical position. The resting surfaces of the troughs are curved in conformity with the radius of curvature of the wire bundles. In view of the specific shape of the troughs 7 and 8 it will be assured that the wire bundles which are heated and cooled in the furnace retain their round shape. As will be evident in particular from FIGS. 1 and 2, the two vats are arranged adjacent to each other, and more specifically, in such a way that they are parallel to each other with regard to their longitudinal central planes 13 and 14. An essential component of the new invention consists in a beam 9 which is located within the furnace and which catches from below a wire bundle 10 inserted into the furnace and does so from the interior of said wire bundle in its vertical longitudinal central plane at the top side and over its entire length. The beam 9 serves the purpose to support the wire bundle 10 in heated condition from above. It also serves to receive the wire bundle 10 when the latter is introduced into the furnace and furthermore serves to introduce said wire bundle first into the cooling vat 2 and subsequently into the heating vat 1 and finally when the wire bundle has been sufficiently heated to lift the same out of the heating vat and into the cooling vat. Finally, the beam 9 is intended to lift the cooled wire bundle out of the cooling vat so that it can be removed from the furnace. In view of the problem to be met by the beam 9, the beam 9 forms according to the invention a portion of a pivoting device which is adapted to move the beam 9 through a semicircle above the vats 7 and 8. Accordingly, the beam 9 has one side thereof connected to a pivot arm 11 which is likewise arranged in the furnace and which is journaled in a vertical plane 12 which is located at the same distance from both vats and therebetween and extends in a direction parallel to the vertical longitudinal central planes 13 and 14 of the vats 7 and 8. The beam 11 is pivotally connected to the pivot arm 11 through the intervention of an arm 15 which is rigidly connected to the beam 11 and extends vertically upwardly. To this end, there is provided a bolt 16. The pivot 11 is mounted on a shaft 17 which is driven by two synchronous extending electric motors 18. The two electric motors are so arranged that they bring about pivoting movement of the beam 9 having the pivot arm 11 capable of being located in both end positions in which the wire bundle 10 immerses into the heating or cooling liquid for a span of movement thereof in a range covering a small acute angle of movement possible both upwardly and downwardly. Such arrangement of the electric motors is known as so-called reversing circuit. The shaft 17 is journaled in bearings 19. Above the beam 9 a second beam 20 is arranged which is spaced from the beam 9 by a distance corresponding to the thickness of a wire bundle. This beam 20 has its front end preferably provided with an upwardly directed bend which at its lower side is slanted in upward direction. In FIG. 3 such slant or inclined surface is designated with the reference numeral 21. The beam 20 prevents the wire bundle in the lead bath of heating vat 1 from floating upwardly. In order to prevent such upward floating, there are furthermore provided two vats 7 and 8 which are arranged in the furnace and which have their head ends provided with upwardly inclined and outwardly directed extensions 22 and 23 respectively. Within the free chamber 24 surrounded by the hood 3 there are provided movable covers 25 for the two vats 7 and 8. The two covers 25 are connected to arms 26 which extend outwardly above the hood 3.

These arms 26 form each with an extension 27 outside the hood 3 a two-arm lever which has its free ends connected to a hydraulically movable connecting rod 28. From FIG. 1 it will be evident that the covers 26 are adapted by the above described device to be lifted off from the vats 7 and 8 so that they will not impede the movement of the wire bundles within the chamber 3. The covers 25 are intended to protect the bath in the vats 1 and 2 against oxygen and to maintain the heat in the bath so that unnecessary heat losses will be avoided.

Figure 2:
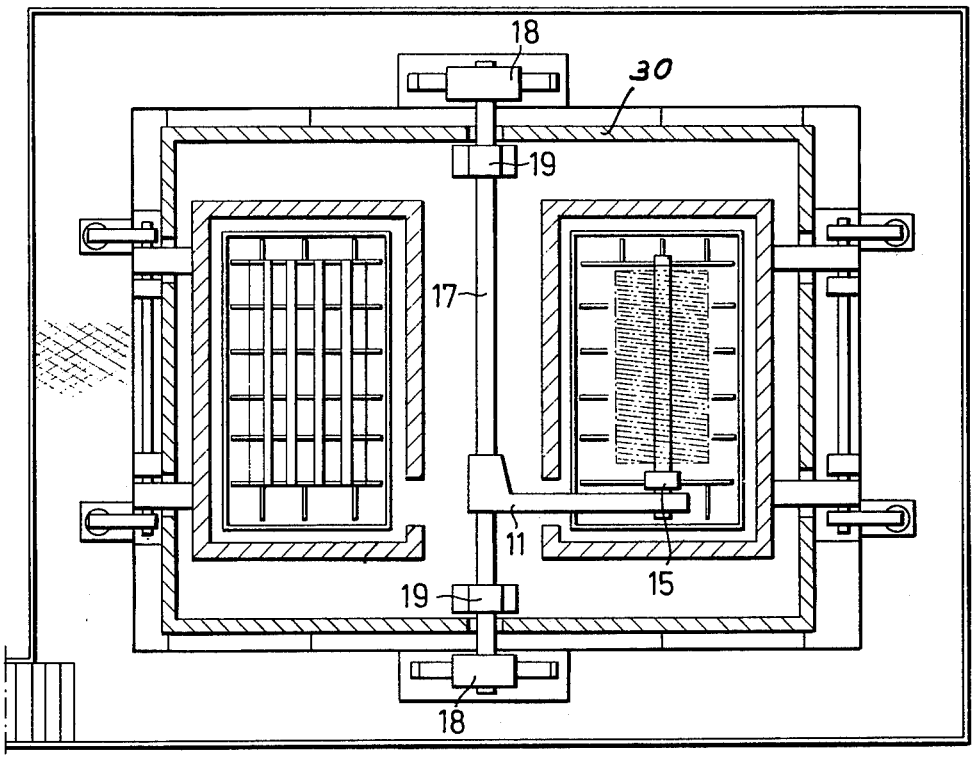
FIG. 2 is a section taken along the line II—II of FIG. 1.
Figure 3:
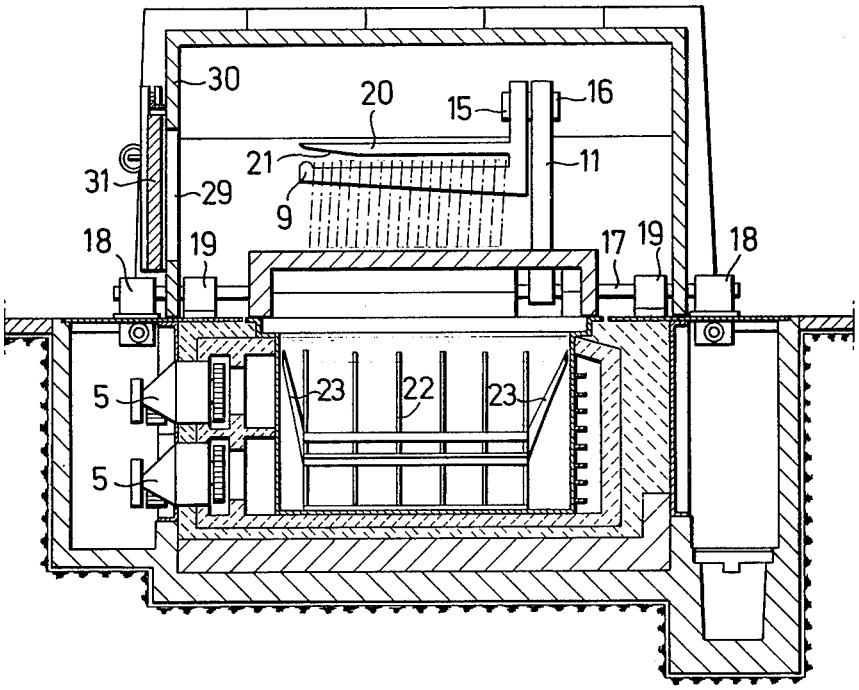
FIG. 3 represents a section taken along the line III—III of FIG. 1.
Figure 5:
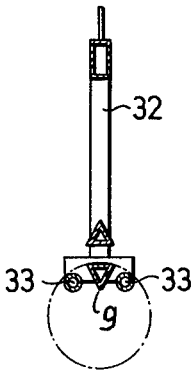
FIG. 5 illustrates a view of that part of the charging machine of FIG. 4 which is seen in the direction of the arrow V in FIG. 4.
Figure 4:
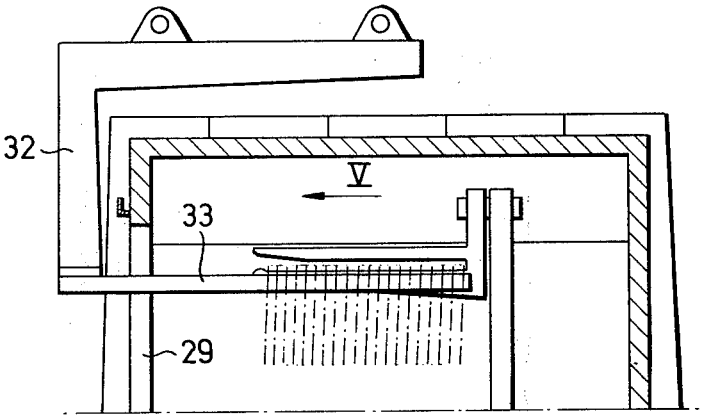
FIG. 4 shows a portion of the charging machine when introducing a wire bundle or coil into the plant.

As will be evident from FIGS. 1 and 2, the refractory enclosure 4 has its upper confinement arranged at the same level as the bottom of a machine hall in which the machine furnace is mounted. In this way it is possible to introduce into and withdraw from the furnace wire bundles in a simple manner through an opening 29 in an end face 30 of hood 3. The opening 29 is adapted to be closed by a cover 31. The introducing and withdrawing of the wire bundles is in conformity with FIG. 4 effected by a charging machine of which only a yoke 32 is shown. The yoke 32 is at its lower end provided with two round bars 33 which are spaced from each other and between which the wire bundle is pushed onto the arm 9.

It is, of course, to be understood that the present invention is, by no means, limited to the specific showing in the drawings, but also comprises any modifications within the scope of the appended claims.

I claim:

1. A method of patenting a loosened steel wire bundle in a steel wire patenting plant having a cooling vat and a heating furnace, which includes in combination the step of first pre-heating the wire bundle in the cooling vat to a desired temperature in said cooling vat, introducing the thus pre-heated wire bundle into said furnace and heating the same to a desired elevated temperature, and subsequently returning the thus heated wire bundle to said cooling vat for cooling said wire bundle to the temperature in said cooling vat to, and simultaneously, at least approximately maintain the desired pre-heating temperature in said cooling vat.

2. A method in combination according to claim 1, in which the desired cooling temperature of said cooling vat is within the range of from about 400° C to 500° C, and in which the desired heating temperature in said furnace is within the range of from about 850° C to 1100° C.

* * * * *